US006453877B1

(12) United States Patent
Lucier et al.

(10) Patent No.: US 6,453,877 B1
(45) Date of Patent: Sep. 24, 2002

(54) FUEL DELIVERY SYSTEM USING TWO PRESSURE REGULATORS WITH A SINGLE ELECTRIC FUEL PUMP

(75) Inventors: Peter E. Lucier, Chicago; Richard P. Kolb, Prairieview, both of IL (US); Harvey Ruth, Maryland Heights, MO (US)

(73) Assignee: Outboard Marine Corporation, Waukegan, IL (US)

( * ) Notice: Subject to any disclaimer, the term of this patent is extended or adjusted under 35 U.S.C. 154(b) by 0 days.

(21) Appl. No.: 09/681,020

(22) Filed: Nov. 28, 2000

(51) Int. Cl.[7] ..... F02M 37/04
(52) U.S. Cl. ..... 123/497; 123/457
(58) Field of Search ..... 123/497, 516, 123/457, 463, 514, 506; 210/129, 167

(56) References Cited

U.S. PATENT DOCUMENTS 4,694,857 A * 9/1987 Harris ..... 137/565
5,389,245 A * 2/1995 Jaeger et al. ..... 210/129
5,551,404 A * 9/1996 Bauerle et al. ..... 123/514
6,318,344 B1 * 11/2001 Lucier et al. ..... 123/516

* cited by examiner

*Primary Examiner*—Tony M. Argenbright
*Assistant Examiner*—Mahmoud M Gimie

(57) ABSTRACT

A fuel delivery system uses a single electric fuel pump to deliver fuel to a fuel injected engine and returns excess fuel to the single electric fuel pump via a vapor separator and two pressure regulators. A primer bulb draws fuel from a fuel tank with a fuel supply line and transfers the fuel to the single electric fuel pump. The single electric fuel pump delivers fuel to a fuel rail assembly, which enables fuel to be distributed to each fuel injector during engine operation. A fuel return line connects the fuel rail assembly to the single electric fuel pump via the vapor separator to remove excess fuel from the fuel rail assembly and to transfer the excess fuel back to the single electric fuel pump for re-circulation. The first pressure regulator maintains a substantially constant pressure within the fuel injectors while the vapor separator purges entrained gas from the excess liquid fuel to avoid vapor lock. The second pressure regulator allows transfer of fuel to the single electric fuel pump from the vapor separator while preventing reverse flow of fuel from the fuel tank to the vapor separator.

38 Claims, 2 Drawing Sheets

FUEL DELIVERY SYSTEM USING TWO PRESSURE REGULATORS WITH A SINGLE ELECTRIC FUEL PUMP

BACKGROUND OF INVENTION

The present invention relates generally to a fuel delivery system for an internal combustion engine and, more particularly, to a fuel delivery system that employs two pressure regulators with a single electric fuel pump to deliver fuel to the engine.

Fuel injection systems are used to supply fuel to many modern engines because their ability to precisely meter fuel flow and accurately control the mixture of fuel and air delivered to an engine dramatically improves engine performance while reducing engine exhaust gas emissions. In one type of fuel injection system, a fuel pump transfers fuel under high pressure directly from a fuel tank to a fuel rail connected to the individual fuel injectors of the engine. Excess fuel not used by the fuel injectors during periods of low engine demand is returned to the fuel tank. Unfortunately, the returned fuel can vaporize or become aerated and foamy, which can lean out the air-fuel mixture delivered to the engine by the fuel pump.

As a result of recent passage of stringent emissions regulations and consumer demand for better performance, there is an increasing demand to employ fuel injection systems in two-stroke engines such as outboard marine engines. However, because the operating environment for outboard marine engines differs enormously from the operating environment for automobile engines, the design engineer faces considerable challenges not faced by the designer of automobile engines. For example, in order to prevent fuel from leaking from the fuel injection system and possibly igniting, U.S. Coast Guard regulations do not allow the use of a pressurized fuel line from a remote fuel tank to inboard engines. While outboards are typically exempt from the federal regulation, ABYC (American Boat & Yacht Council) standards which reflect the federal regulations, are generally applicable. U.S. Coast Guard regulations also prohibit the return of excess fuel from the fuel injectors to the fuel tank, as is typically done in automotive fuel injection systems. Hence, many fuel injection systems of the type commonly used in automobile engines are not usable in marine engines and some other two-stroke engines.

One proposed solution to the problem of injecting fuel in an engine without requiring the use of a pressurized external fuel line or a fuel return system requires dual fuel pumps for delivering fuel to the engine. A fuel delivery system 80 incorporating this proposed solution is schematically illustrated in FIG. 1. The fuel delivery system 80 includes first and second fuel pumps 88 and 92 that are located in a fuel supply line 84 and that are collectively configured to pump fuel from a fuel tank 82 to fuel injectors of the engine. In use, fuel is transferred first, under vacuum through the fuel supply line 84 from fuel tank 82 to fuel pump 88 through a primer bulb 86. (The primer bulb 86 is used only to prime the system with fuel before the start-up.) From the first fuel pump 88, fuel is transferred through the fuel supply line 84 to a vapor separator 90, where entrained vapor in the fuel is removed via a vent 98. Finally, the second fuel pump 92 transfers fuel from the vapor separator to all of the fuel injectors at a second, higher pressure than the first pressure generated by the first fuel pump 88. A pressure regulator 96 regulates the fuel pressure to the fuel injectors from the second fuel pump 92. Excess fuel from the second pump returns through the pressure regulator 96 to the vapor separator 90 through a fuel return line 94. The returned fuel is then available for use by the second fuel pump 92.

The pumping of excess fuel needlessly wastes power. Consequently, the first fuel pump 88 and the second fuel pump 92 run more often than necessary and use more power than is needed to supply an adequate amount of fuel at an adequate pressure under most engine operating condition. Also, the return of fuel to the vapor separator 90 carries engine heat to the fuel delivery system 80 that can increase the temperature and vapor pressure of the fuel in the fuel delivery system. The increased temperature and vapor pressure may cause fuel to flash into a vapor, leading to an effect commonly referred to as vapor lock. Vapor lock can result in erratic engine operation, loss of power output, or even cause the engine to stall or overheat.

Another major disadvantage of the fuel delivery system 80 illustrated in FIG. 1 is that it requires two fuel pumps 88 and 92. In some outboards, the first pump is a lift pump and is crankcase pulse driven while the second pump is electric. In others, both are electric. This can be problematic because electrical power demands on boats are rising due to a proliferation of electrically powered devices. These devices include convenience lights, headlights, compact disc players, and fish-locaters, as well as other electric power consuming devices and instruments. Every effort is being made to minimize the electrical power consumption of all outboard marine engine components in order to permit the use of a relatively small battery and/or alternator. These efforts may be frustrated if the engine's electrical system must supply power to two separate electric pumps.

Another problem that may occur in certain types of internal combustion engines is an occasional inability to pump fuel, either from a fuel tank to a vapor separator or from the vapor separator to the combustion chambers of the engine. For instance, a fuel injected engine may continuously re-circulate portions of the fuel from the engine's injectors back to the vapor separator. This continuous re-circulation of excess liquid fuel raises the temperature of the fuel and increases the likelihood that the fuel will reach a temperature at which it will vaporize within the fuel delivery system. If the fuel vaporizes to a gaseous state, certain types of pumps are unable to pump the vaporized fuel.

In view of the above-described potential problems relating to a fuel injected engine, the need therefore has arisen to provide a fuel delivery system that could remove excess liquid fuel from the fuel injectors and transfer the excess fuel back to the inlet of a single electric fuel pump of the engine without causing a vapor lock. It would be significantly beneficial if a fuel delivery system could be provided which does not require a separate low pressure fuel pump to transfer fuel from the fuel tank to the engine.

SUMMARY OF INVENTION

The invention relates to a fuel delivery system and method using two pressure regulators with a single electric fuel pump to deliver fuel to a fuel injector of an engine such as an outboard marine engine and to return excess fuel to the single electric fuel pump while avoiding vapor lock.

Accordingly, the present invention includes a single electric fuel pump that pumps fuel through a fuel supply line that connects a fuel tank to at least one fuel injector of the engine. A fuel return line connects the fuel injector to the single electric fuel pump via a vapor separator to remove excess liquid fuel from the fuel injector and to transfer the excess liquid fuel back to the single electric fuel pump for re-circulation. A first pressure regulator is disposed in the fuel return line upstream of the vapor separator to maintain a substantially constant pressure within the fuel injector while the vapor separator is purging entrained gas from the excess liquid fuel to prevent vapor lock. A second pressure regulator, located downstream of the vapor separator, allows the transfer of fuel to the single electric fuel pump from the vapor separator and also prevents reverse flow of fuel from the fuel tank to the vapor separator. This also serves to bias the pump inlet such that fuel is always drawn from the tank before being drawn from the separator. An engine control unit (ECU) receives a fuel pressure signal from a pressure sensor and transmits a fuel supply signal to the single electric fuel pump.

In accordance with another aspect of the invention, a method is provided for delivering fuel to at least one fuel injector of an engine. In accordance with this method, a single electric fuel pump draws fuel from the fuel tank via a fuel supply line and delivers the fuel to the fuel injector. Excess liquid fuel is removed from the fuel injector via a fuel return line and is transferred to the single electric fuel pump through a vapor separator for re-circulation. A first pressure regulator maintains a substantially constant pressure within the fuel injector while the vapor separator purges entrained gas from the excess liquid fuel. A second pressure regulator transfers excess liquid fuel back to the single electric fuel pump through the fuel return line while preventing reverse flow of fuel from the fuel tank to the vapor separator.

Various other features objects and advantages of the present invention will be made apparent from the following detailed description and the drawings.

BRIEF DESCRIPTION OF DRAWINGS

Preferred exemplary embodiments of the invention are illustrated in the attached drawings in which like reference numerals represent like parts throughout and in which.

DETAILED DESCRIPTION

Figure 1:
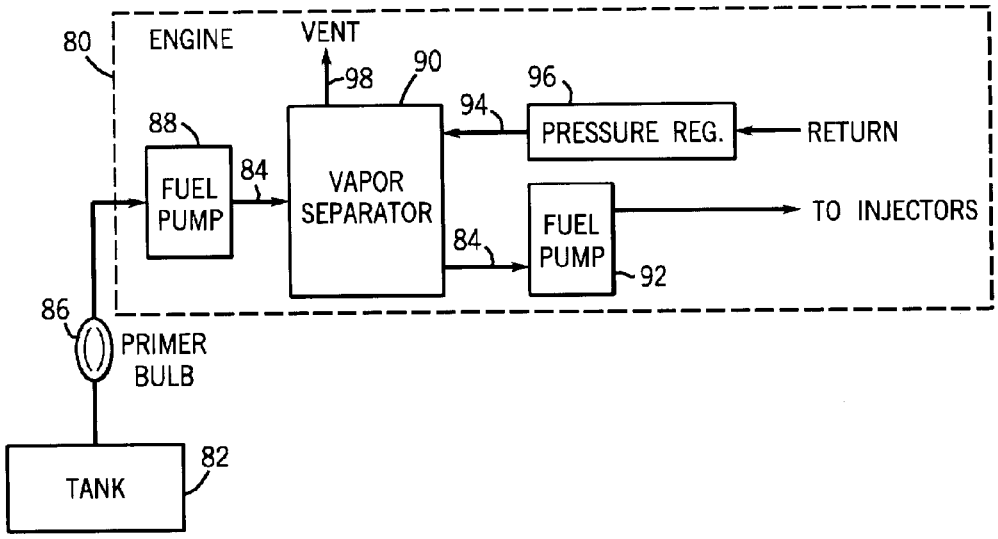
FIG. 1 PRIOR ART
FIG. 1 is a schematic diagram of a prior art fuel delivery system employing two fuel pumps.
Figure 2:
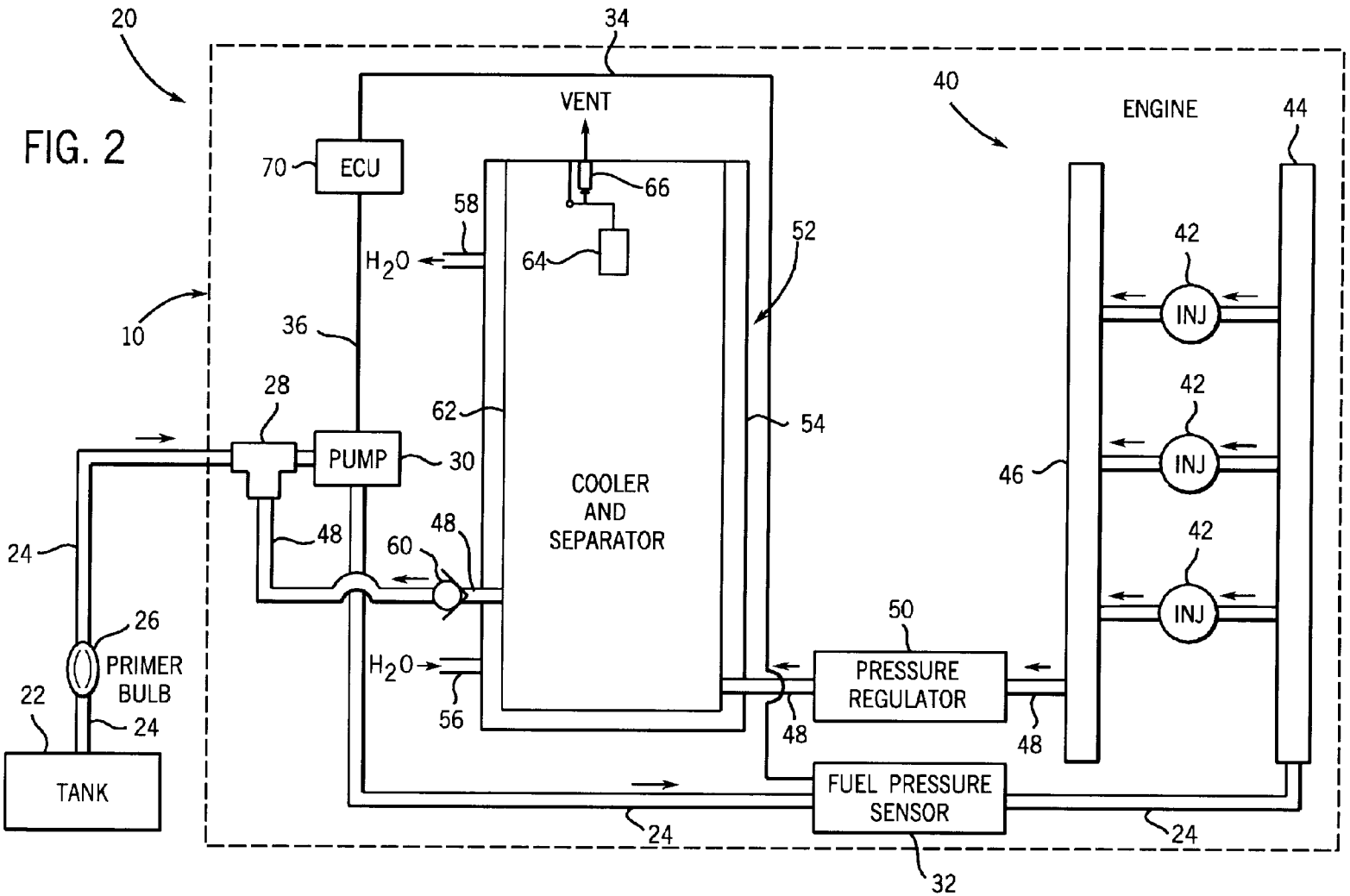
FIG. 2 is a schematic diagram of a fuel delivery system employing two pressure regulators, a single electric fuel pump, and a fuel return line in accordance with a preferred embodiment of the present invention.

Referring to FIG. 2, a preferred embodiment of a fuel delivery system 20 is illustrated that employs a single high-pressure electric fuel pump 30 to deliver fuel to a plurality of fuel injectors 42 of an engine 10. Most of the system 20 is located on the engine 10. The only external components are a fuel tank 22 and a primer bulb 26. The primer bulb 26 is used only to prime the system 20 with fuel prior to starting the engine 10. The single high-pressure electric fuel pump 30 draws fuel from the fuel tank 22 via a fuel supply line 24 and transfers the fuel into engine 10. The fuel then flows into the single high-pressure fuel pump 30.

A fuel rail assembly 40, located downstream of the single high-pressure fuel pump 30, receives the pressurized fuel and distributes the pressurized fuel to the fuel injectors 42 of the engine 10 during engine operation. The fuel rail assembly 40 includes a supply rail 44 and a return rail 46 which both are connected to the fuel injectors 42. The supply rail 44 receives fuel from the pump 30 via the supply line 24 and distributes the pressurized fuel to the fuel injectors 42. The return rail 46 removes all excess liquid fuel from the fuel rail assembly 40 and returns the fuel to a vapor separator 52 via a fuel return line 48. Although the preferred embodiment uses the fuel injectors 42 in a parallel configuration, the fuel injectors 42 alternatively could also be positioned in a series configuration. Moreover, in the case of a one-cylinder engine, the fuel rail assembly 40 could be eliminated, in which case the supply and return lines 24 and 48 would be connected directly to the fuel injector 42.

The vapor separator. 52 removes vapor from the excess liquid fuel and transfers the excess liquid fuel back to the single electric fuel pump 30 for recirculation. The vapor separator 52 includes a standpipe 62 and a liquid coolant jacket 54 that envelops the standpipe 62. The liquid coolant jacket 54 controls the temperature of the excess liquid fuel entering the single electric fuel pump 30. The liquid coolant jacket 54 has an inlet port 56 and outlet port 58 for circulating liquid coolant through the liquid coolant jacket 54. The liquid coolant may, for example, comprise engine coolant supplied by the engine's coolant pump (not shown). To remove gas that may be entrained by the excess liquid fuel, a float 64 and a vent valve 66 are mounted in the standpipe 62. The vent valve 64 opens when the float 62 raises under the buoyant force of the fuel in the standpipe 62. A vapor separator suitable for these purposes is disclosed in U.S. Pat. No. 6,012,434. The standpipe 62 has an inlet and outlet ports connected to the fuel return lines 48*a* and 48*b* respectively.

A first pressure regulator 50 is located in the fuel return line 48 between the fuel rail assembly 40 and the vapor separator 52. The first pressure regulator 50 maintains a substantially constant, relatively high pressure of, e.g., 15 psi in the fuel injectors 42 while the vapor separator 52 is purging gas that may be entrained by the excess liquid fuel to avoid vapor lock during engine operation.

A second pressure regulator 60 is located in a portion of the return fuel line 48 that connects the vapor separator 52 to the fuel supply line 24 via a Tee-connector 28 located upstream of the fuel pump 30. The second pressure regulator 60 preferably comprises a check valve that maintains a fuel pressure that is higher than the fuel pressure at the inlet port of the single electric fuel pump 30. For instance, the check valve 60 may maintain a fuel pressure differential of 6 psi across itself. If the pressure differential across the check valve 60 exceeds 6 psi, then the check valve 60 will open and allow excess liquid fuel to flow from the vapor separator 52 to the single electric fuel pump 30. Because the single electric fuel pump 30 draws fuel at a pressure of not more than 3 psi, the check valve 60 typically will open when the pressure in the fuel return line 48 is less than 4 psi.

A pressure sensor 32 is located in the fuel supply line 24 downstream of the single electric fuel pump 30. An engine control unit (ECU) 70 receives a pressure signal 34 from the pressure sensor 32 and transmits a fuel supply signal 36 to the single electric fuel pump 30. Based at least in part on these signals, the ECU 70 controls the operation of the pump 30 to maintain a commanded, possibly constant pressure at each fuel injector 42 so that each fuel injector 42 precisely meters proper quantities of fuel for efficient operation of the engine 10. The ECU 70 also operates in conjunction with the single electric fuel pump 30 to prevent any time lag in the fuel delivery associated with overcoming inertia of the pump components during an increase in fuel demand.

the present invention contemplates the use of a fuel injector of a type commonly referred to as a single fluid pressure surge direct delivery fuel injector used in gasoline engines, and more specifically, in two-stroke gasoline engines. One application of such an injector is a two-stroke gasoline outboard marine engine. These fuel injectors typically do not entrain gasoline in a gaseous mixture before injection. However, it will be appreciated by those skilled in the art that the above-described invention is equally suited for use with other types of injectors and other types of engines. For example, pressure control valve may be coupled at one end of the fuel rail assembly to regulate the level of pressure of the fuel supplied to the injectors to maintain a substantially constant pressure. The fuel supply rail may incorporate nipples that allow the fuel injectors to receive fuel from the fuel rail assembly. Thus, in this case, a substantially steady pressure differential, as opposed to a pressure surge, between the fuel supply rail and the nipples causes the fuel to be injected into the fuel chamber. Another example of direct fuel injection is a direct dual-fluid injection system that includes a compressor configured to provide a source of gas under pressure to effect injection of the fuel to the engine. That is, the fuel injectors deliver a metered individual quantity of fuel entrained in a gaseous mixture. It is to be understood, however, that the present invention is not limited to any particular type of direct fuel injector.

The present invention has been described in terms of the preferred embodiment, and it is recognized that equivalents, alternatives, and modifications, aside from those expressly stated, are possible and within the scope of the appending claims.

What is claimed is:

1. A fuel delivery system with two pressure regulators comprisng:

(A) a fuel tank;

(B) a fuel supply line connecting the fuel tank to at least one fuel injector of an engine;

(C) a single fuel pump disposed in the fuel supply line to supply fuel to the fuel injector, (D) a fuel return line connecting the fuel injector to the single fuel pump to remove excess fuel from the fuel injector;

(E) a vapor separator disposed in the fuel return line and having a ventilation system;

(F) a first pressure regulator and a second pressure regulator disposed in the fuel return line, the first pressure regulator maintaining a substantially constant pressure within the fuel injector while the vapor separator is purging entrained gas from the excess fuel, and the second pressure regulator allowing transfer of the excess fuel back to the single fuel pump through the fuel supply lie while preventing reverse flow of fuel from the fuel tank to the vapor separator.

2. The fuel delivery system of claim 1 wherein the single fuel pump is an electric fuel pump, the system farther comprising a pressure sensor disposed in the fuel supply line and configured to sense fuel pressure in the fuel supply line and to produce a pressure signal in response thereto and an engine control unit connected to the pressure sensor and configured to receive the fuel pressure signal from the pressure sensor and transmit a fuel supply signal to the single electric fuel pump.

3. The fuel delivery system of claim 2 wherein the pressure sensor and the engine control unit are connected to provide feedback to the single electric fuel pump to maintain a substantially constant pressure in the fuel delivery system.

4. The fuel delivery system of claim 2 wherein the pressure sensor is disposed in the fuel supply line downstream from the single electric fuel pump.

5. The fuel delivery system of claim 1 wherein the engine comprises a plurality of fuel injectors and further comprising: (1) a fuel rail assembly that is connected to the single fuel pump through the fuel supply line and that supplies fuel to the fuel injectors and (2) a return rail that returns excess fuel to the vapor separator from the fuel injector.

6. The fuel delivery system of claim 5 wherein the first pressure regulator is located between the fuel rail assembly and the vapor separator.

7. The fuel delivery system of claim 5 wherein the second pressure regulator is located between the vapor separator and an inlet port of the single fuel pump.

8. The fuel delivery system of claim 5 wherein the second pressure regulator is a check valve.

9. The fuel delivery system of claim 8 wherein the check valve is connected to the supply fuel line through a Tee-connector and maintains a higher fuel pressure tham the fuel pressure at the inlet port of the fuel pump.

10. The fuel delivery system of claim 8 wherein the vapor separator is connected to the check valve and maintains a higher fuel pressure than the fuel pressure across the check valve.

11. The fuel delivery system of claim 1 wherein the vapor separator includes a standpipe having an inlet connected to an upstream portion of the fuel return line and an outlet connected to a downstream portion of the fuel return line.

12. The fuel delivery system of claim 11 wherein the standpipe is enveloped in a liquid coolant jacket.

13. The fuel delivery system of claim 12 wherein the liquid coolant jacket has an inlet port and an outlet port for circulating liquid coolant through the liquid coolant jacket.

14. The fuel delivery system of claim 1 further comprising a primer bulb located in the fuel supply line externally of the engine.

15. The fuel delivery system of claim 1 wherein the engine is an outboard marine engine.

16. A fuel delivery system with two pressure regulators comprising:

(A)a fuel tank located externally of a two-stroke engine; and (B)a fuel delivery system having:

(1)a fuel supply line connecting the fuel tank to a fuel rail assembly;

(2)a single electric fuel pump disposed in the fuel supply line and located outside of the fuel tank;

(3)a fuel return line connecting the fuel rail assembly to the single electric fuel pump to remove excess fuel from the fuel rail assembly and to transfer the excess fuel back to the single electric fuel pump for re-circulation;

(4)a vapor separator disposed in the fuel return line and having a ventilation system;

(5)a first pressure regulator and a second pressure regulator disposed in the fuel return line, the first pressure regulator maintaining a substantially constant pressure within at least a portion of the fuel rail assembly while the vapor separator is purging entrained gas from the excess fuel, and the second pressure regulator allowing transfer of excess fuel to the single electric fuel pump from the vapor separator while preventing reverse flow of fuel from the fuel tank to the vapor separator.

17. The fuel delivery system of claim 16 further comprising a pressure sensor disposed in the fuel supply line and configured to sense fuel pressure in the fuel supply line and to produce a pressure signal in response thereto, and an engine control unit connected to the pressure sensor and configured to receive the fuel pressure signal thereof and to communicate a fuel supply signal to the single fuel pump.

18. The fuel delivery system of claim 16 wherein the fuel rail assembly includes a supply rail, a return rail, and a plurality of fuel injectors disposed between the supply rail and the return rail.

19. The fuel delivery system of claim 18 wherein the plurality of fuel injectors are configured in parallel with one another.

20. The fuel delivery system of claim 18 wherein the plurality of fuel injectors are configured in series with one another.

21. The fuel delivery system of claim 18 wherein the supply rail is connected to the single electric fuel pump and the return rail is connected to the vapor separator.

22. The fuel delivery system of claim 16 wherein the vapor separator includes a standpipe having an inlet connected to the fuel rail assembly through the fuel return line and an outlet connected to the fuel supply line through the fuel return line.

23. The fuel delivery system of claim 22 wherein the standpipe is enveloped in a liquid coolant jacket, the liquid coolant jacket having an inlet port and an outlet port for circulating liquid coolant through the liquid coolant jacket.

24. The fuel delivery system of claim 16 further comprising a primer bulb located in the fuel supply line externally of the two-stroke engine.

25. A method for delivering fuel to at least one fuel injector of a two-stroke engine, the method comprising the steps of:

(A) drawing fuel firm a fuel tarn and transferring the fuel through a fuel supply line using no more than one fuel pump;

(B) transferring the fuel to a fuel rail assembly from the fuel pump;

(C) delivering the fuel to the fuel injector from the fuel rail assembly;

(D) removing excess fuel from the fuel injector through a fuel return line and transferring the excess fuel back to a vapor separator;

(E) maintaining a substantially constant pressure within the fuel injector while the vapor separator purges entrained gas from the excess fuel;

(F) transferring excess fuel back to an inlet of the fuel pump from the vapor separator while preventing reverse flow of fuel from the fuel tank to the vapor separator.

26. The method of claim 25 further comprising priming the fuel pump prior to engine star-up by operating a primer bulb located in the fuel supply line externally of the two-stroke engine.

27. The method of claim 25 wherein the step of delivering fuel with the fuel pump further includes controlling the option of the fuel pump using an engine control unit and a pressure sensor.

28. The method of claim 25 further comprising controlling the temperature of the fuel in a standpipe of the vapor separator by circulating liquid coolant through a liquid coolant jacket that envelopes the standpipe.

29. The method of claim 25 further comprising venting gas from a vent port of the standpipe under control of a float that raises under a buoyant force of liquid fuel in the standpipe.

30. A fuel delivery system comprising:

(A) means for drawing fuel from a fuel tank and transferring the fuel to a single electric fuel pump through a fuel supply line;

(B) means for transferring the fuel to a fuel rail assembly from the single electric fuel pump;

(C) means for delivering the fuel to the fuel injector from the fuel rail assembly;

(D) means for removing excess fuel from the fuel injector through a fuel return line and transferring the excess fuel back to a vapor separator;

(E) means for maintaining a substantially constant pressure within the fuel injector while the vapor separator purges entrained gas from the excess fuel;

(F) means for combining excess fuel from the vapor separator and the fuel tank and transferring the excess fuel to an inlet of the single electric fuel pump while preventing reverse flow of fuel from the fuel tank to the vapor separator.

31. The fuel delivery system of claim 30 wherein the vapor separator includes a standpipe and a liquid coolant jacket which envelops the standpipe.

32. The fuel delivery system of claim 30 wherein the means for maintaining a substantially constant pressure within the fuel injector includes a pressure regulator disposed in a return line connecting the fuel rail assembly to the vapor separator.

33. The fuel delivery system of claim 30 wherein the means for transferring excess fuel back to an inlet of the single electric fuel pump from the vapor separator includes a pressure regulator disposed in a return line connecting the vapor separator to the inlet of the single electric fuel pump.

34. A fuel delivery system with two pressure regulators comprising:

a fuel tank;

a fuel supply line connecting the fuel tank to at least one fuel injector of an engine;

a single electric fuel pump disposed in the fuel supply line to supply fuel to the fuel injector;

a fuel return line connecting the fuel injector to the single electric fuel pump to remove excess fuel from the fuel injector;

a vapor separator disposed in the fuel return line and having a ventilation system;

a first pressure regulator and a second pressure regulator disposed in the fuel return line, the first pressure regulator maintaining a substantially constant pressure within the fuel injector while the vapor separator is purging entrained gas from the excess fuel, and the second pressure regulator allowing transfer of the excess fuel back to the single electric fuel pump through the fuel supply line while preventing reverse flow of fuel from the fuel tank the vapor separator;

a plurality of fuel injectors and father comprises: (1) a fuel rail assembly that is connected to the single electric fuel pump through the fuel supply line and that supplies fuel to the fuel injectors; and (2) a return rail that returns excess fuel to the vapor separator from the fuel injector; and wherein the second pressure regulator is located between the vapor separator and an inlet port of the single electric fuel pump.

35. A fuel delivery system with two pressure regulators comprising:

a fuel tank;

a fuel supply line connecting the fuel tank to at least one fuel injector of an engine;

a single electric fuel pump disposed in the fuel supply line to supply fuel to the fuel injector;

a fuel return line connecting the fuel injector to the single electric fuel pump to remove excess fuel from the fuel injector;

a vapor separator disposed in the fuel return line having a ventilation system and a standpipe having an inlet connected to an upstream portion of the fuel return line and an outlet connected to a downstream portion of the fuel return line;

a first pressure regulator and a second pressure regulator disposed in the fuel return line, the first pressure regulator maintaining a substantially constant pressure within the fuel injector while the vapor separator is purging entrained gas from the excess fuel, and the second pressure regulator allowing transfer of the excess fuel back to the single electric fuel pump through the fuel supply line while preventing reverse flow of fuel from the fuel tank to the vapor separator.

36. The fuel delivery system of claim 35 wherein the standpipe is enveloped in a liquid coolant jacket.

37. The fuel delivery system of claim 36 wherein the liquid coolant jacket has an inlet port and an outlet port for circulating liquid coolant through the liquid coolant jacket.

38. A fuel delivery system comprising:

means for drawing fuel from a fuel tank and transferring the fuel to a single electric fuel pump through a fuel supply line;

means for transferring the fuel to a fuel rail assembly from the single electric fuel pump;

means for delivering the fuel to the fuel injector from the fuel rail means for removing excess fuel from the fuel injector through a fuel line and transferring the excess fuel back to a vapor separator, wherein the vapor separator includes a standpipe and a liquid coolant Jacket which envelopes the standpipe;

means for maintaining a substantially constant pressure within the fuel injector while the vapor separator purges entrained gas from the excess fuel;

means for transferring excess fuel back to an inlet of the single electric fuel pump from the vapor separator while preventing reverse flow of fuel from the fuel tank to the vapor separator.

* * * * *

UNITED STATES PATENT AND TRADEMARK OFFICE

CERTIFICATE OF CORRECTION

PATENT NO. : 6,453,877 B1
DATED : September 24, 2002
INVENTOR(S) : Lucier et al.

It is certified that error appears in the above-identified patent and that said Letters Patent is hereby corrected as shown below:

Column 5,
Line 50, delete “lie” and substitute therefor -- line --;
Line 53, delete “farther” and substitute therefor -- further --;

Column 7,
Line 30, delete “tarn” and substitute therefor -- tank --.
Line 49, delete “star-up” and substitute therefor -- start-up --.
Line 54, delete “option” and substitute therefor -- operation --.

Column 8,
Line 52, delete “father” and substitute therefor -- further --.

Column 10,
Line 9, insert -- assembly; -- after “fuel rail” and a paragraph return after “assembly;”.
Line 10, insert -- return -- after “fuel”.

Signed and Sealed this

Eleventh Day of February, 2003

JAMES E. ROGAN
*Director of the United States Patent and Trademark Office*